US005373991A

United States Patent [19]

Nelson

[11] Patent Number: 5,373,991

[45] Date of Patent: Dec. 20, 1994

[54] FOAMER TRIGGER DISPENSER WITH SEALING DEVICE

[75] Inventor: Philip L. Nelson, Ellisville, Mo.

[73] Assignee: Contico International, Inc., St. Louis, Mo.

[21] Appl. No.: 45,631

[22] Filed: Apr. 9, 1993

[51] Int. Cl.[5] ..... B05B 9/043

[52] U.S. Cl. ..... 239/333; 239/343; 239/514; 222/546

[58] Field of Search ..... 239/333, 343, 428.5, 239/504, 505, 514; 222/383, 380, 546, 190

[56] References Cited

U.S. PATENT DOCUMENTS

| | | | |
|---|---|---|---|
| 1,791,440 | 2/1931 | Aronson . | |
| 1,900,087 | 3/1933 | Aronson . | |
| 3,650,473 | 3/1972 | Malone . | |
| 3,913,841 | 10/1975 | Tada . | |
| 4,153,203 | 5/1979 | Tada . | |
| 4,219,159 | 8/1980 | Wesner | 239/343 |
| 4,230,277 | 10/1980 | Tada . | |
| 4,350,298 | 9/1982 | Tada . | |
| 4,463,905 | 8/1984 | Stoesser et al. | 239/428.5 |
| 4,598,862 | 7/1986 | Rice | 239/343 |
| 4,603,812 | 8/1986 | Stoesser et al. . | |
| 4,606,480 | 8/1986 | Gazulla | 239/333 |
| 4,669,665 | 6/1987 | Shay . | |
| 4,730,775 | 3/1988 | Maas . | |
| 4,767,060 | 8/1988 | Shay et al. . | |
| 4,768,717 | 9/1988 | Shay . | |
| 4,779,803 | 10/1988 | Corsette | 239/428.5 |
| 4,815,663 | 3/1989 | Tada . | |
| 4,883,227 | 11/1989 | Maas . | |
| 4,890,792 | 1/1990 | Martin et al. . | |
| 4,911,361 | 3/1990 | Tada . | |
| 4,925,106 | 5/1990 | Maas et al. | 239/343 |
| 4,932,567 | 6/1990 | Tanabe et al. | 239/343 |
| 4,953,791 | 9/1990 | Tada . | |
| 4,958,754 | 9/1990 | Dennis | 239/333 |
| 5,064,103 | 11/1991 | Bennett | 239/343 |
| 5,156,307 | 10/1992 | Callahan et al. | 239/343 |
| 5,158,233 | 10/1992 | Foster et al. | 239/333 |

*Primary Examiner*—Karen B. Merritt
*Attorney, Agent, or Firm*—Rogers, Howell & Haferkamp

[57] ABSTRACT

The invention is particularly directed to a trigger sprayer having screen support structure for foaming a dispensed liquid where the support structure is comprised of a plurality of annular shoulders of varying diameters adapted to screens of differing diameters such that the distance between the nozzle and screen may be varied and thereby change the foam pattern of the dispensed liquid to obtain an optimum foam pattern for any particular liquid, and to the incorporation of a door connected with the sprayer nozzle housing for sealing the opening of a foam dispensing passage of the foamer trigger sprayer.

25 Claims, 1 Drawing Sheet

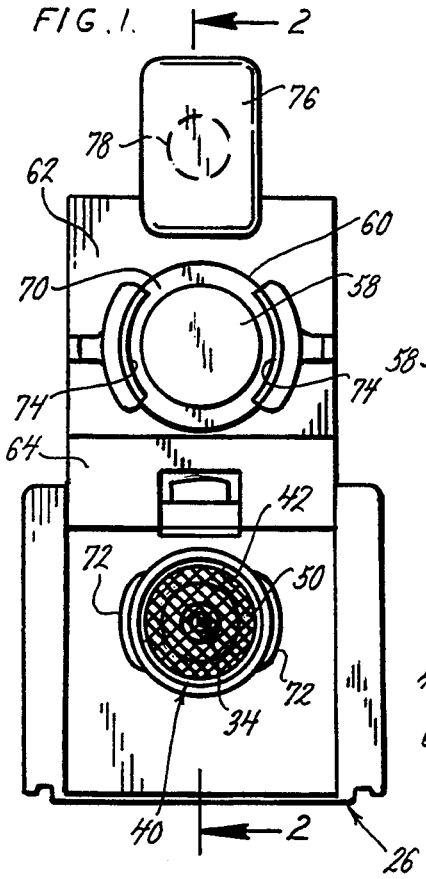
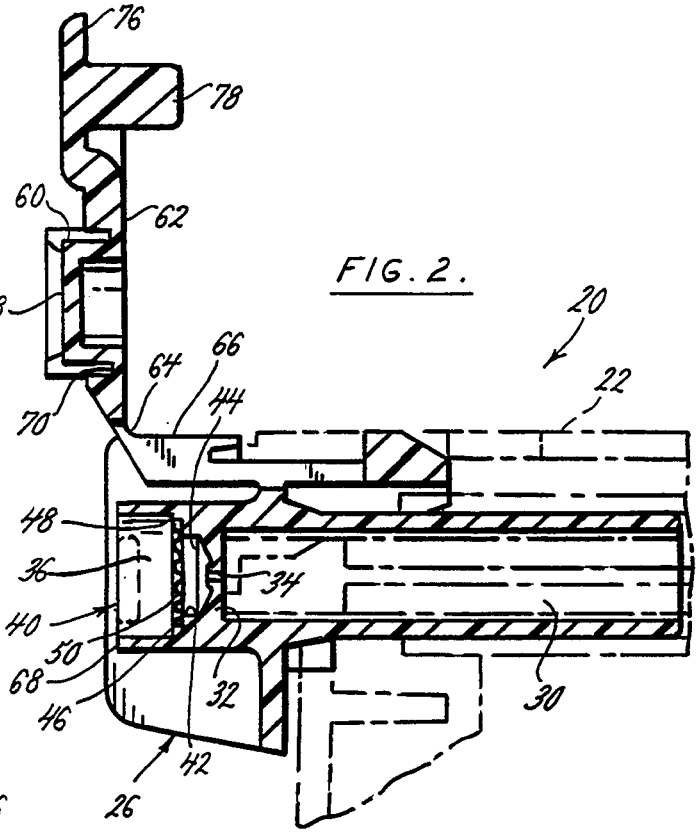
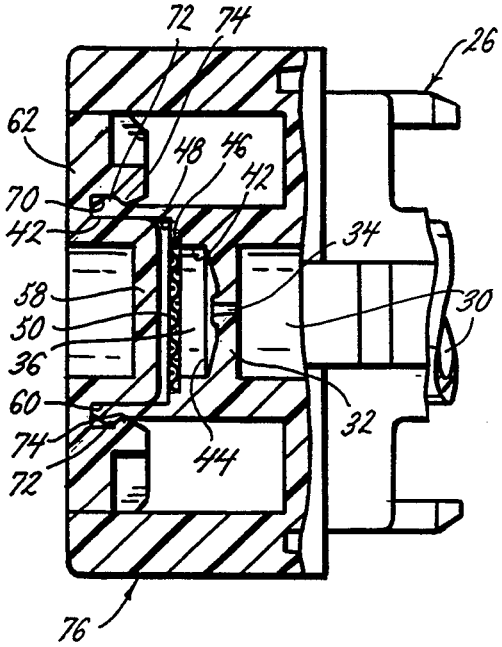
FIG. 4.
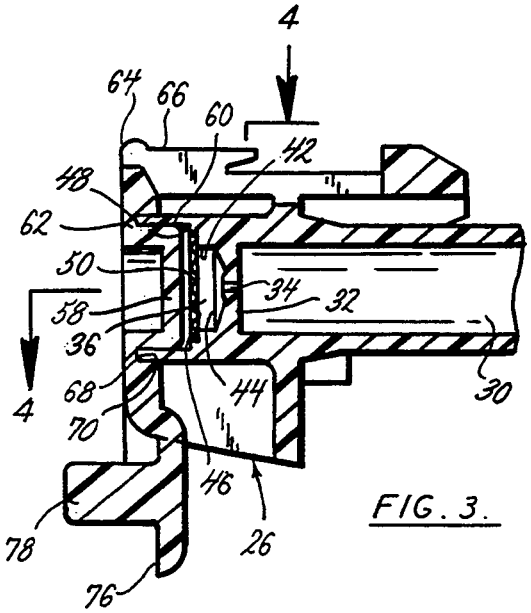
FIG. 3.

FOAMER TRIGGER DISPENSER WITH SEALING DEVICE

BACKGROUND OF THE INVENTION

This invention is directed to the field of trigger dispensers, also known as trigger sprayers. The invention is particularly directed to a trigger sprayer having structure for foaming a dispensed liquid where the structure is adapted for adjustments to vary the foam pattern of the dispensed liquid to obtain an optimum foam pattern for any particular liquid, and to the incorporation of a device integral with the sprayer nozzle housing for sealing the opening of a foam dispensing passage of the foamer trigger sprayer.

There are numerous patents that have issued on trigger dispensers of the general type to which this invention relates. The patents discussed below exemplify such trigger dispensers. Generally, a trigger dispenser of the type involved here is a relatively low-cost pump device which is held in the hand and which has a trigger operable by squeezing or pulling the fingers of the hand to pump liquid from a container and through a nozzle at the front of the dispenser.

Such trigger dispensers may have a variety of features that have become common and well-known in the industry. For example, the dispenser may be a dedicated sprayer that produces a defined spray pattern for the liquid as it is dispensed from the nozzle. It is also known to provide adjustable spray patterns such that with a single dispenser the user may select any one of several stream patterns from a stream to a fine mist. Some known trigger dispensers also include a way to seal the dispenser to prevent liquid from leaking from the nozzle orifice during shipment or non-use. A variety of sealing arrangements are known as will be more fully explained.

It is also well-known to provide trigger dispensers with a means to produce foaming of the liquid as it is dispensed from the nozzle orifice. Such trigger dispensers are generally referred to in the industry as "foamers". Typically, the foam is produced by providing a structure forward of the nozzle orifice upon which the liquid from the orifice impinges to produce turbulence, and thus foaming of the liquid and/or the added structure has openings for admitting air for entrapment by the liquid to cause the foaming. Various types of foamers are known as will be more fully described below. A common attribute of foamers is that the foam pattern they dispense is not adjustable because the structure forward of the nozzle that produces the foaming of the liquid is constructed in a fixed position from the nozzle. This is not a problem in use of known foamers because it usually is not necessary to vary foam patterns as it is spray patterns. However, in many situations to get the optimum foam pattern the position of the foaming structure relative to the nozzle orifice of a foamer is determined by the particular liquid with which the foamer is to be used. Therefore, many foamers are specifically designed for use with a particular foaming agent of the liquid with the position of the foaming structure relative to the nozzle orifice being fixed to produce the optimum foam pattern for the particular liquid. If the trigger dispenser is to be used with another liquid it may have to be reconstructed with the foaming structure repositioned relative to the nozzle orifice to obtain the optimum spray pattern for the other liquid.

Also, it is well known to provide foamers with a means for sealing the orifice to prevent leakage of the fluid from the dispenser during shipment or non-use. Examples of known foamers with sealing means are described below. As will be more fully described, the present invention is specifically directed to a trigger dispenser of the foamer type having structure for adjusting or varying the foaming pattern and to adapt the foamer for use with different foaming liquids, and with a simpler and less expensive means for sealing the dispenser from leakage during shipment or non-use.

U.S. Pat. No. 4,350,298 discloses a foamer trigger dispenser of several embodiments. A first embodiment is shown in FIGS. 1 and 2 where a hinged door may be placed in position in front of the nozzle orifice to produce a foam. No means are provided for sealing the orifice. The door positions the foaming structure at a fixed position in front of the nozzle orifice so the dispenser is not readily adaptable for use with different foaming liquids that would require the structure to be repositioned relative to the orifice to obtain an optimum foaming pattern of the liquids.

The embodiment of FIGS. 5–9 has a nozzle cap that produces foaming and where the cap is operable in a sliding or push-pull fashion. The nozzle includes a sealing member or rod which is capable of closing the nozzle orifice. By sliding the nozzle to the extended position, the dispenser operates as a foamer, and by sliding the nozzle to the retracted position the rod seals the orifice and prevents leakage. This embodiment has the advantage of a means for preventing leakage, but has the disadvantage of having a push-pull type nozzle. Nozzles that operate between open and closed positions by either a push-pull operation or a twisting or turning operation have the disadvantage that the user finds it difficult to operate the nozzle. The user may not know how to operate it at all, or may think it should be operated by turning when it should be operated by push-pull, or vice versa. This embodiment also has the disadvantages of being more complex to manufacture and of not being adapted for use with various different foaming liquids.

A third embodiment is shown in FIGS. 10–13. The nozzle cap that produces foaming is screwed to the dispenser body and operates between a sealing position and a foaming position by turning the cap. This embodiment has the disadvantage of requiring a screw cap that must be turned by the user to operate the dispenser between a closed non-leak position, and an open foaming position. As with the previous embodiment, users are often confused as how to operate a dispenser that has either a twist cap or a push-pull cap. Also, the screw cap requires molding a separate part and thereby adds to the expense of the dispenser and the cap is not adapted for use with various different foaming liquids.

U.S. Pat. No. 4,463,905 and 4,603,812 disclose a foamer trigger dispenser with a hinged door having a screen such that pivoting the door to a position in front of the nozzle orifice produces foaming, and pivoting the door so as to remove the screen from in front of a nozzle orifice produces a spray. With the dispenser of these patents the hinged door is for the purpose of selecting either the spray or foaming condition. The door positions the screen at a fixed distance in front of the nozzle orifice so the dispenser is not readily adaptable for use with different foaming liquids which would require the screen to be repositioned relative to the orifice to obtain the best foaming pattern of the liquids. While the trigger dispensers of these patents do not appear to have a means for sealing the orifice against leakage, it is known in the art to provide such a sprayer with a twist nozzle whereby the nozzle, including the hinged door, is turned between off and on positions. In the off position the liquid is prevented from reaching the orifice while in the on position the liquid is allowed to flow to the orifice. This dispenser, with a nozzle that must be rotated between seal and non-seal positions, has the same disadvantages as noted above.

U.S. Pat. No. 4,669,665 discloses a foamer nozzle which includes a cylinder extending forwardly of the nozzle orifice such that the spray from the orifice impinges on the inner cylindrical wall of the cylinder to produce turbulence, aeration, and foaming of the liquid. No sealing means are disclosed for preventing leakage. However, other trigger sprayers are known in the art that have a nozzle with a foaming cylinder extending forwardly of the nozzle in axial alignment with the nozzle. The foaming cylinder has radially extending holes at its base . The cylinder is of a diameter and length such that the spray from the orifice impinges on the inner cylindrical wall of the cylinder to produce turbulence, and such that air is drawn inwardly through the openings to mix with the turbulent spray within the cylinder to produce foaming, assuming of course that the liquid has a foaming agent. This foamer also has a means for sealing against leakage which includes a twist-type nozzle which is turned between on and off positions. In the on position liquid is allowed to pass through the orifice whereas in the off position the liquid flow to the orifice is blocked. This foamer has the same disadvantages as with the other foamers having twist or screw-type nozzles.

Other prior art patents representative of foamer trigger dispensers having foamer nozzles of the twist cap or screw cap type, or sliding push-pull type, some of which have means for sealing the orifice, are U.S. Pat. Nos. 4,730,775, 4,767,060, 4,768,717, 4,779,803, 4,883,227, 4,890,792, 4,911,361, and 4,953,791. U.S. Pat. No. 4,779,803 combines twist and push-pull operations whereby the nozzle is turned or twisted to operate it between off and spray positions, with a moveable element which slides between a retracted position where it does not influence the spray from the orifice and an extended position spaced forwardly of the nozzle orifice to modulate the spray and produce foaming, if the liquid contains a foaming ingredient. The foamer of this patent has the disadvantages of twist-type nozzle and push-pull operation as heretofore explained.

Other examples of foamer trigger dispensers are shown by Japanese Patents 63-193556, 1-110863, and 2-61456. The dispensers of these patents have an integrally hinged door with an opening in the door and a cylindrical portion surrounding the opening and extending rearwardly therefrom toward the nozzle orifice. When the door is in its closed position, the cylinder also surrounds the nozzle orifice and becomes axially aligned with the orifice such that spray from the orifice impinges on the inner cylindrical wall of the cylinder to produce foaming, the foam exiting through the opening in the hinged door. The foaming structure is not readily adaptable for optimum use with various different types of foaming liquids. While Japanese Patent 63-193556 does not show any means for sealing the orifice to prevent leakage, it is known in the prior art to provide a separate plug insert with a cylindrical portion that fits within the door cylinder. At the opposite side of the cylindrical portion is a semi-spherical element. With the cylindrical portion of the plug inserted into the door cylinder, and with the door closed, the semi-spherical element seats within the nozzle orifice to seal the orifice. The separate plug is inserted for shipping to prevent leakage, but must be removed in order to use the dispenser as a foamer.

U.S. Pat. Nos. 4,153,203, 4,230,277, and 4,815,663 and Japanese Patents 3-32758 and 57-32626 disclose trigger dispensers having a nozzle cover or door connected to the nozzle with an integrally formed hinge. The cover may be pivoted between a locked position where it is out of the way of the nozzle orifice so that liquid may be sprayed from the dispenser by operation of the trigger, and a seal position where the cover overlies the nozzle orifice to prevent liquid from leaking from the orifice such as during shipment or non-use. The cover has a central seal section with a semi-spherical portion (76/176) which seats against the nozzle orifice with the cover in the seal position to seal the orifice. While the patent discloses a desirable integrally hinged door pivotable between an operating position and a seal position, and thus overcomes the disadvantages of trigger dispensers utilizing twist or push-pull type nozzles for that purpose, there is no disclosure in the patent of any means for producing foam.

To summarize the prior art, there are foamer trigger dispensers which have pins that seat within the nozzle orifice to seal the orifice against leakage, but with such foamers the orifice and pin are moved relative to each other between sealing and non-sealing positions by either turning the nozzle or sliding the nozzle with a push-pull operation. The turning or sliding action assures that the path of movement of the pin will be restricted to an axial path within a cylinder, thereby assuring that the path of the pin will not intersect any portion of the wall of the cylinder. Thus, such foamers have the disadvantages of being confusing to operate and of not being readily adaptable for use with different types of foaming liquids as explained above. Other prior art foamers have hinged doors that may be pivoted between open and closed positions to select either spray or foam, but such foamers are not readily adapted for use with different types of foaming liquids, and either have no means at all to prevent leakage, or if they do have such means they require a separate plug which is relatively expensive and must be removed to use the foamer or require turning the nozzle with the disadvantages heretofore explained. There are also prior art trigger dispensers with hinged doors that may be pivoted between seal and non-seal positions and where the door has a semispherical element that seats in the orifice to seal the orifice with the door in the seal position. However, such dispensers are not foamers.

Thus, the prior art suggests that a seal for the nozzle orifice of a nonfoaming trigger sprayer can be on a hinged door, but the door is mounted in general vertical alignment with the orifice. However, on a trigger sprayer having a foam inducing cylinder projecting forward of the nozzle orifice, an elongated pin having an end for sealing the nozzle orifice must be moved axially within the foam inducing cylinder, or the orifice sealer must be on a separate removable element. Moreover, the foaming structure of trigger sprayers is typically constructed in a fixed position from the nozzle orifice best suited for a particular foaming liquid and to adapt the sprayer for use with another liquid the foaming structure and nozzle orifice must be reconstructed.

The present invention overcomes the disadvantages of the prior art foamers and provides a unique foamer trigger dispenser having a foam producing screen that is easily positioned at any one of a variety of different distances from the nozzle orifice best suited for the particular foaming liquid to be used with the dispenser and with means for sealing against leakage such as during shipment or non-use, which is relatively inexpensive to manufacture, and which is exceptionally easy to use.

SUMMARY OF THE INVENTION

In accordance with the foamer trigger dispenser of this invention, the nozzle has an orifice through which liquid is dispensed upon operation of the trigger. A foam dispensing passage, preferably cylindrical, is formed integrally with the nozzle. The passage or cylinder extends forwardly from the nozzle in axial alignment with the nozzle. A screen is selectively positioned along the longitudinal length of the cylinder such that the spray from the orifice impinges on the screen to produce turbulence. Assuming that the liquid has a suitable foaming agent, the turbulence created by the spray striking the screen, and air mixing with the turbulent spray, produce foaming of the liquid which is dispensed from the open end of the dispensing passage. The screen may be positioned at a variety of different positions along the longitudinal length of the dispensing passage to obtain optimum foaming of the liquid for the particular foaming agent employed in the liquid.

Sealing means are provided to seal the foamer against leakage. In accordance with this invention the sealing means comprises a door integrally hinged to the nozzle, preferably at the top thereof. The door is pivotal between a closed position where the door overlies the front of the nozzle housing, and thereby overlies the open end of the foam dispensing passage, and an open position with the door unobstructing the liquid emitted from the nozzle. Suitable latching means are provided for releasably securing the door in its closed position, and the living hinge incorporates a memory that positions the door in its open position when the securing means are removed.

As an important feature of the invention the door includes a cylindrical projection such that with the door closed the projection is in axial alignment with the orifice and the dispensing passage. The periphery of the cylinder has a surface that seats within the interior surface of the dispensing passage in sealing engagement therewith to seal the passage against leakage when the door is closed. When the door is open, the cylindrical projection swings away from the dispensing passage opening out of sealing engagement therewith. The geometry of the foam dispensing passage, door pivot axis, and sealing cylindrical projection position and length are such that the projection clears the dispensing passage and screen upon opening and closing the door, and is in axial alignment with the dispensing passage and in sealing engagement therewith with the door closed, all of which is accomplished without any degradation in performance in producing foaming.

The nozzle and hinged door assembly is easy to use and inexpensive to manufacture, being integrally formed. No separate plug or turning or reciprocating of the nozzle is required for sealing.

BRIEF DESCRIPTION OF THE DRAWINGS

FIG. 1 is a front elevation view of the trigger sprayer with the door in the open position.

FIG. 2 is a view in section of the trigger sprayer taken along the plane of the line 2—2 of FIG. 1 with the door in the open position.

FIG. 3 is a view in section similar to that of FIG. 2 but with the door in the closed position.

FIG. 4 is an enlarged view in section taken along the plane of the line 4—4 of FIG. 3 with the door in the closed position.

DETAILED DESCRIPTION OF THE PREFERRED EMBODIMENT

A trigger sprayer foamer of the type provided by the present situation is disclosed in U.S. Pat. No. 5,158,233, assigned to the assignee of the present invention. The trigger sprayer foamer of the invention 20, which is made entirely of plastic, has a housing 22 that is adapted to be threaded onto liquid receptacle (not shown). A nozzle assembly 26 on the forward end of the housing 22 regulates the character of fluids sprayed by the trigger sprayer 20. A trigger assembly (not shown) is manually operable in any of the known manners to pump liquid from the receptacle through a fluid supply passage 30 within the housing 22 to the nozzle assembly 26.

Within the housing 22 and forming a part of the fluid supply passage, there is a swirl chamber in the fluid supply passage 30 adjacent the passage front wall 32 and in the usual manner, a spinner (shown in phantom lines) in the swirl chamber develops a swirling action to the liquid being pumped through the passageway in the housing 22 to the swirl chamber. The swirl chamber has a forward wall 32 through which there is a nozzle outlet orifice 34.

To create a foaming action of the liquid (which would incorporate a foaming agent) a fluid dispensing passage 36, preferably having the configuration of a cylindrical tube, is integral with the nozzle assembly 26 and extends forwardly of the front wall 32 of the swirl chamber in the fluid supply passage 30. The upstream end or entrance of the passage 36 surrounds and is spaced radially outward from the nozzle discharge orifice 34. The downstream or discharge end 40 of the dispensing passage 36 opens through the housing 22. The fluid dispensing passage 36 has an interior side wall 42 having an inner surface that is cylindrical. The inner surface of the interior side wall 42 has a plurality of annular shoulders 44, 46, 48 provided thereon. Each of the plurality of shoulders 44, 46, 48 extends completely around the interior surface of the side wall 42. As best seen in FIG. 4, the shoulder 44 positioned closest to the nozzle orifice 34 along the longitudinal length of the fluid dispensing passage 36 tapers toward the center axis of the passage and the nozzle orifice 34. The diameter of each of the shoulders 44, 46, 48 measured laterally across the interior of the fluid dispensing passage 36 increases for each shoulder spaced longitudinally along the fluid dispensing passage from the nozzle orifice 34. The longitudinal distance of each of the three shoulders 44, 46, 48 from the nozzle orifice 34 enables a screen 50 to be adjustably positioned and mounted in the dispensing passage spaced from the nozzle orifice. The ability to adjustably position the screen 50 along the longitudinal length of the fluid dispensing passage 36 at selected distances from the nozzle orifice 34 enables the trigger sprayer foamer 20 to be used with a variety of different liquids having different foaming agents without requiring reconstruction of the nozzle assembly 26 to best suit the foaming agent of the particular liquid used with the foamer. If the foamer is to be used with a liquid having a foaming agent that causes the optimum foaming pattern of the liquid to be achieved when the liquid is dispensed from a sprayer nozzle and through a screen positioned close to the nozzle, the screen 50 may be adjustably positioned against the rightmost shoulder 44 shown in FIG. 4 or the shoulder closest to the nozzle orifice 34. The screen 50 would be provided having a circular configuration with a diameter slightly larger than the diameter of the fluid dispensing passage 36 adjacent the largest annular shoulder 48. To adapt the screen 50 for positioning against the-smallest annular shoulder 44, it would only be necessary to trim away the excess portion of the screen surrounding its periphery reducing the screen diameter to that slightly larger than the interior diameter of the fluid dispensing passage 36 adjacent the smallest annular shoulder 44. Inserting the screen into the fluid dispensing passage through the housing opening 40 and against the smallest annular shoulder 44 would cause the screen peripheral edge to engage in friction engagement against the dispensing passage interior side wall 42 thereby mounting the screen securely in the passage adjacent and abutting the smallest diameter shoulder 44. Should the trigger sprayer foamer 20 be intended for use with a liquid having a foaming agent that produces an optimum foaming pattern when sprayed from the orifice 34 through the screen 50 with the screen positioned laterally further away from the orifice than the screen being positioned adjacent the first annular shoulder 44, a smaller portion of the screen would be trimmed away from its periphery so that the screen could be press fit in friction engagement against the fluid dispensing passage interior side wall 42 adjacent the intermediate shoulder 46. Should the trigger sprayer foamer be used with a liquid having a foaming agent that produces the optimum foaming pattern with the screen positioned still further away from the nozzle orifice 34 the screen 50 would have its peripheral edge trimmed to adapt the screen to be press fit into friction engagement against the dispensing passage interior side wall 42 adjacent and abutting the largest of the three annular shoulders 48. In this manner, the same trigger sprayer foamer 20 may be employed with different liquids having different foaming agents where the screen 50 is adjustably positioned along the longitudinal length of the dispensing passage 36 at a plurality of different distances from the nozzle orifice 34, the particular distance being chosen to achieve the optimum foaming pattern of the liquid employed with the sprayer foamer.

To provide a seal against leakage when the trigger sprayer is being shipped or is not in use, a plastic projection 58 is provided having a cylindrical configuration with an exterior surface 60 adapted to engage in sealing engagement with the fluid dispensing passage interior side wall surface 42. More specifically, the cylindrical projection 58 projects from and is integrally molded with a door 62 that in turn is integrally molded with the nozzle assembly 26 through a living hinge 64. The door 62 is pivotally connected by the living hinge 64 to an upper wall 66 of the nozzle assembly 26. The hinge may be formed of two components separated by a gap as illustrated or as a single continuous hinge.

In the closed position of the door 62 shown in FIGS. 3 and 4, the projection 58 is generally positioned coaxial with the axis of the cylindrical fluid dispensing passage 36 and its cylindrical sealing exterior surface 60 seats against the cylindrical interior surface of the dispensing passage adjacent the passage opening. The length of the projection is chosen to space it longitudinally from the orifice 34 and the screen 50 for all adjusted positions of the screen. When the door 62 is in the open position, such as illustrated in FIG. 2, it and the projection 58 are positioned substantially beyond the path of flow of fluid from the housing opening of the dispensing passage 36. This open position of the door 62 may be upright as illustrated in FIG. 2 or may be a position angularly clockwise of the position illustrated in FIG. 2 so long as the door 62 and the projection 58 are substantially free from obstructing the fluid flow.

The swinging door 62 would not work if it were hinged at or near the dispensing passage 36 because the projection 58 would be obstructed by the lowermost portion 68 of the dispensing passage opening 40. The hinge 64 may be set slightly rearward of the housing opening 40 in which event the door 62 is provided with an annular recess 70 of a depth generally equal to that setback. When the door 62 is swung to the closed position the recess 70 receives the end portion of the dispensing passage 36 as illustrated in FIG. 3.

While the living hinge 64 returns the door 62 to the generally open position because of the internal memory of the living hinge, releasable locking means are provided for releasably locking the door 62 in its closed position. This releasable locking means may comprise a pair of keepers 72 molded on opposite sides of the dispensing passage tube 36 that cooperate with a pair of yieldable detents 74 that .project from the door 62. The detents 74 yield and snap in place behind the keepers 72 to lock the door in the closed position. A lever 76 is provided at the free end of the door that can be grasped to disengage the keepers 72 and allow the door 62 to be swung open. The lever 76 may be provided with a finger engaging projection 78 to prevent the operator's finger from sliding off the lever 76 when the door is being swung toward a closed position from its open position.

Use

Important advantages of this invention is that the trigger sprayer foamer 20 incorporates an adjustably positioned foam-inducing screen 50 in the fluid dispensing passage 36 with an easily operable and less costly orifice sealing means. Since trigger sprayers are produced very inexpensively, small cost savings are of large significance. The sealing means of the present invention is of low cost because it is formed integral with the nozzle assembly 26 in a single molding procedure. The prior art separate removable nozzle sealing component that must be separately made is eliminated.

The sealing means of this invention is easy to use and the manner of use is obvious to the consumer. When the trigger sprayer is shipped or it is not in use, leakage of liquid is prevented by simply closing the door 62. This is accomplished by finger pressure applied to the lever 76 and against the finger projection 78. Because of the strategic location of the hinge 64 the sealing projection 58 will clear the end 68 of the fluid dispensing passage as the door is swung from its open position. As the door reaches the closed position illustrated in FIGS. 3 and 4, the latch means will releasably latch the door closed such that the detents 74 engage the keepers 72 as the seal projection 58 automatically aligns with the axis of the fluid dispensing passage 36 and the cylindrical sealing surface 60 of the projection seats in sealing engagement with the dispensing passage interior surface 42.

When it is desired to operate the trigger sprayer foamer 20, the lever 76 is engaged by the operator's finger and pressure is applied to release the latching means and swing the door 62 to its open position. As the door is swung, the sealing projection 58 automatically disengages from contact with the dispensing passage interior surface 42.

With the door in the open position, such as illustrated in FIGS. 1 and 2, the trigger can be operated in its usual manner to cause the trigger sprayer to dispense a foamed liquid. Thereafter, the door 62 can be closed again and the nozzle orifice 34 will again be sealed fluid-tight behind the engagement of the projection 58 and the dispensing passage interior surface.

While the present invention has been described by reference to specific embodiments, it should be understood that modifications and variations of the invention may be constructed without departing from the scope of the invention defined in the following claims.

What is claimed is:

1. An apparatus for dispensing a foam from a trigger sprayer, the apparatus comprising:

a housing having a fluid supply passage extending therethrough, the supply passage communicating with a source of fluid;

a nozzle orifice extending through a wall of the housing, the housing wall having opposite first and second sides and the fluid supply passage communicating with the nozzle orifice on the first side of the housing wall;

a fluid dispensing passage extending through the housing and communicating with the nozzle orifice on the second side of the housing wall, the dispensing passage having a longitudinal length extending from the second side of the housing wall to an opening in the housing where the dispensing passage exits the housing;

a screen adapted to be received inside the fluid dispensing passage; and, means for mounting the screen stationary within the fluid dispensing passage at a plurality of different positions along the longitudinal length of the fluid dispensing passage and at a plurality of different distances from the nozzle orifice.

2. The apparatus of claim 1, wherein:

means are provided on the housing for selectively covering over the opening in the housing and sealing the fluid dispensing passage.

3. The apparatus of claim 2, wherein:

the means for covering over the housing opening includes a door connected to the housing for movement of the door between a closed position where the door covers over the housing opening and an open position where the door is displaced from the housing opening, and a projection is provided on the door, the projection being configured to engage inside and seat against an interior surface of the fluid dispensing passage and thereby seal the passage with the door moved to the closed position.

4. The apparatus of claim 3, wherein:

the projection engages inside and seats against the interior surface of the fluid dispensing passage adjacent the opening in the housing and spaced along the longitudinal length of the fluid dispensing passage from the screen and the nozzle orifice.

5. The apparatus of claim 1, wherein:

the means for mounting the screen within the fluid dispensing passage includes a plurality of shoulders provided inside the fluid dispensing passage at a plurality of different positions along the longitudinal length of the fluid dispensing passage and at a plurality of different distances from the nozzle orifice, the screen being adapted to be inserted into the fluid dispensing passage and mounted against a selected one of the plurality of shoulders thereby adjustably positioning the screen in the fluid dispensing passage at the position along the longitudinal length and at the distance from the nozzle orifice as the selected one of the shoulders.

6. The apparatus of claim 5, wherein:

the fluid dispensing passage has a cylindrical interior surface and the plurality of shoulders are annular shoulders provided on the interior surface, and the interior surface of the fluid dispensing passage has a plurality of different interior diameters with the interior diameter decreasing at each shoulder of the plurality of shoulders as the fluid dispensing passage extends from the opening to the housing wall.

7. The apparatus of claim 5, wherein:

the screen is press-fit in friction engagement inside the fluid dispensing passage and against the selected one of the plurality of shoulders thereby securing the screen inside the fluid dispensing passage.

8. An apparatus for dispensing a foam from a trigger sprayer, the apparatus comprising:

a housing having a fluid supply passage extending therethrough, the supply passage being configured to contain a fluid spinner and communicating with a source of fluid at one end of the supply passage and having a forward wall at an opposite end of the supply passage;

a nozzle orifice extending through the forward wall, the forward wall having opposite first and second sides and the fluid supply passage communicating with the nozzle orifice on the first side of the forward wall;

a fluid dispensing passage extending through the housing and communicating with the nozzle orifice on the second side of the forward wall, the dispensing passage having a longitudinal length extending from the second side of the housing wall to an opening in the housing where the fluid dispensing passage exits the housing; and, a door connected to the housing for movement of the door between a closed position where the door covers over the housing opening and an open position where the door is displaced from the housing opening, the door having means for locking the door in the closed position covering over the housing opening and additional means to seal the housing opening with the door moved to the closed position thereby sealing the fluid dispensing passage;

the means to seal the housing opening includes a projection on the door, the projection being configured to extend through the housing opening and into the fluid dispensing passage with the door moved to the closed position and to seat in engagement against an interior surface of the fluid dispensing passage thereby sealing the fluid dispensing passage; and, with the door moved to the closed position the projection seats inside the fluid dispensing passage in a position longitudinally spaced from the nozzle orifice.

9. The apparatus of claim 8, wherein:

means are provided inside the fluid dispensing passage for producing a foam from liquid passed through the nozzle orifice; and, with the door moved to the closed position the projection seats inside the housing opening and inside the fluid dispensing passage in a position longitudinally spaced from the means for producing a foam and the nozzle orifice.

10. The apparatus of claim 8, wherein:

the means for locking the door in the closed position includes at least one detent that projects from the door, the detent being configured to engage against the housing with the door moved to the closed position to thereby lock the door in the closed position.

11. An apparatus for dispensing a foam from a trigger sprayer, the apparatus comprising:

a housing having a fluid supply passage extending therethrough, the supply passage being configured to contain a fluid spinner and communicating with a source of fluid at one end of the supply passage and having a forward wall at an opposite end of the supply passage;

a nozzle orifice extending through the forward wall, the forward wall having opposite first and second sides and the fluid supply passage communicating with the nozzle orifice on the first side of the forward wall;

a fluid dispensing passage extending through the housing and communicating with the nozzle orifice on the second side of the forward wall, the dispensing passage having a longitudinal length extending from the second side of the housing wall to an opening in the housing where the fluid dispensing passage exits the housing; and, a door connected to the housing for movement of the door between a closed position where the door covers over the housing opening and an open position where the door is displaced from the housing opening, the door having means for locking the door in the closed position covering over the housing opening and additional means to seal the housing opening with the door moved to the closed position thereby sealing the fluid dispensing passage;

the means to seal the housing opening includes a projection on the door, the projection being configured to extend through the housing opening and into the fluid dispensing passage with the door moved to the closed position and to seat in engagement against an interior surface of the fluid dispensing passage thereby sealing the fluid dispensing passage; and, means are provided inside the fluid dispensing passage for producing a foam from liquid passed through the nozzle orifice; and, the means for producing a foam includes a screen adapted to be mounted inside the fluid dispensing passage at a plurality of different positions along the longitudinal length of the fluid dispensing passage and at a plurality of different distances from the nozzle orifice.

12. The apparatus of claim 11, wherein:

the fluid dispensing passage has an interior surface with a plurality of shoulders provided thereon, each shoulder of the plurality of shoulders being spaced at a different position along the longitudinal length of the fluid dispensing passage and at a different distance along the fluid dispensing passage from the nozzle orifice, and the screen is adapted to be mounted inside the fluid dispensing passage with a peripheral edge of the screen engaging in friction engagement with the interior surface of the fluid dispensing passage and with the screen engaging against a selected one of the plurality of shoulders thereby mounting the screen inside the fluid dispensing passage at a selected position along the longitudinal length of the fluid dispensing passage and at a selected distance from the nozzle orifice.

13. The apparatus of claim 12, wherein: the fluid dispensing passage has a cylindrical interior surface and the plurality of shoulders are annular shoulders provided on the interior surface, and the interior surface of the fluid dispensing passage has a plurality of different interior diameters with the interior diameter decreasing at each shoulder of the plurality of shoulders as the fluid dispensing passage extends from the opening to the housing wall.

14. The apparatus of claim 13, wherein:

the screen is press-fit in friction engagement inside the fluid dispensing passage and against the selected one of the plurality of shoulders thereby securing the screen inside the fluid dispensing passage.

15. The apparatus of claim 11, wherein:

the means for locking the door in the closed position includes at least one detent that projects from the door, the detent being configured to engage against the fluid dispensing passage with the door moved to the closed position to thereby lock the door in the closed position.

16. An apparatus for dispensing a foam from a trigger sprayer, the apparatus comprising:

a housing having a fluid supply passage extending therethrough, the supply passage being configured to contain a fluid spinner and communicating with a source of fluid at one end of the supply passage and having a forward wall at an opposite end of the supply passage;

a nozzle orifice extending through the forward wall, the forward wall having opposite first and second sides and the fluid supply passage communicating with the nozzle orifice on the first side of the forward wall;

a fluid dispensing passage extending through the housing and communicating with the nozzle orifice on the second side of the forward wall, the dispensing passage having a longitudinal length extending from the second side of the housing wall to an opening in the housing where the fluid dispensing passage exits the housing; and, a door connected to the housing for movement of the door between a closed position where the door covers over the housing opening and an open position where the door is displaced from the housing opening, the door having means for locking the door in the closed position covering over the housing opening and additional means to seal the housing opening with the door moved to the closed position thereby sealing the fluid dispensing passage;

the means to seal the housing opening includes a projection on the door, the projection being configured to extend through the housing opening and into the fluid dispensing passage with the door moved to the closed position and to seat in engagement against an interior surface of the fluid dispensing passage thereby sealing the fluid dispensing passage; and, the means for locking the door in the closed position includes at least one detent that projects from the door, the detent being configured to engage against the housing and position the interior surface of the fluid dispensing passage between the detent and the projection on the door with the door moved to the closed position, thereby locking the door in the closed position.

17. An apparatus for dispensing a foam from a trigger sprayer, the apparatus comprising:

a housing having a fluid supply passage extending therethrough, the supply passage communicating with a source of fluid;

a nozzle orifice extending through a wall of the housing, the housing wall having opposite first and second sides and the fluid supply passage communicating with the nozzle orifice on the first side of the housing wall;

a fluid dispensing passage extending through the housing and communicating with the nozzle orifice on the second side of the housing wall, the dispensing passage having a longitudinal length extending from the second side of the housing wall to an opening in the housing where the dispensing passage exits the housing;

a screen mounted inside the fluid dispensing passage; and, a door mounted to the housing for pivoting movement of the door about a pivot line spaced reward of the opening in the housing for movement of the door between a closed position where the door covers over the housing opening and an open position where the door is displaced from the housing opening.

18. The apparatus of claim 17, wherein:

a projection is provided on the door, the projection being configured to engage inside and seat against an interior surface of the fluid dispensing passage and thereby seal the passage with the door moved to the closed position.

19. The apparatus of claim 18, wherein:

the projection engages inside and seats against the interior surface of the fluid dispensing passage adjacent the opening in the housing and spaced along the longitudinal length of the fluid dispensing passage from the screen and the nozzle orifice.

20. The apparatus of claim 17, wherein:

the door has means thereon for locking the door in the closed position covering over the housing opening.

21. The apparatus of claim 20, wherein:

the means for locking the door in the closed position includes at least one detent that projects from the door, the detent being configured to engage against the fluid dispensing passage with the door moved to the closed position to thereby lock the door in the closed position.

22. The apparatus of claim 20, wherein:

the means for locking the door in the closed position includes at least one detent that projects from the door, the detent being configured to engage against the housing and position the interior surface of the fluid dispensing passage between the detent and the projection on the door with the door moved to the closed position, thereby locking the door in the closed position.

23. The apparatus of claim 20, wherein:

the means for locking the door in the closed position includes at least one detent that projects from the door, the detent being configured to engage against the housing with the door moved to the closed position to thereby lock the door in the closed position.

24. An apparatus for dispensing a foam from a trigger sprayer, the apparatus comprising:

a housing having a fluid supply passage extending therethrough, the supply passage communicating with a source of fluid;

a nozzle orifice extending through a wall of the housing, the housing wall having opposite first and second sides and the fluid supply passage communicating with the nozzle orifice on the first side of the housing wall;

a fluid dispensing passage extending through the housing and communicating with the nozzle orifice on the second side of the housing wall, the dispensing passage having a longitudinal length extending from the second side of the housing wall to an opening in the housing where the dispensing passage exits the housing;

a screen mounted inside the fluid dispensing passage;

a door connected to the housing by a hinge means;

a projection extending from the door, the projection being configured to engage inside and seat against an interior surface of the fluid dispensing passage and thereby seal the passage with the door moved to a closed position;

the hinge means positioned for pivoting the door between an open position at which the door and projection are substantially out of the path of liquid flowing from the fluid dispensing passage and the closed position;

a pivot axis of the hinge means being laterally spaced from the fluid dispensing passage a sufficient distance to enable the projection to clear the housing opening when the door is pivoted toward the fluid dispensing passage and to locate the projection in the closed position against the interior surface of the fluid dispensing passage when the door is adjacent the housing opening;

the door has means thereon for locking the door in the closed position covering over the housing opening; and, the means for locking the door in the closed position includes at least one detent that projects from the door, the detent being configured to engage against the housing and position the interior surface of the fluid discharge passage between the detent and the projection on the door with the door moved to the closed position to thereby lock the door in the closed position.

25. The apparatus of claim 24, wherein:

the projection is positioned substantially coaxial with fluid dispensing passage when the door is in the closed position and so that the projection is engaged inside and seated against the interior surface of the fluid dispensing passage and thereby sealing the passage when the door is in the closed position.

* * * * *